US005331945A

United States Patent [19]

Somerton

[11] Patent Number: 5,331,945

[45] Date of Patent: Jul. 26, 1994

[54] COMBINATION STOVE TOP COVER AND CUTTING BOARD FOR RECREATIONAL VEHICLES

[75] Inventor: Michael G. Somerton, Goodlettsville, Tenn.

[73] Assignee: Camco Manufacturing, Inc., Greensboro, N.C.

[21] Appl. No.: 14,403

[22] Filed: Feb. 5, 1993

[51] Int. Cl.[5] ..... F24C 15/10

[52] U.S. Cl. ..... 126/211; 126/221; 126/214 R; 269/302.1

[58] Field of Search ..... 126/211, 214 R, 220, 126/221; 108/50; 269/302.1, 289 R, 303, 315.13, 301.2

[56] References Cited

U.S. PATENT DOCUMENTS 1,675,051 6/1928 Porter ..... 126/221

FOREIGN PATENT DOCUMENTS 233209 4/1964 Austria ..... 126/211

*Primary Examiner*—Larry Jones

[57] ABSTRACT

A sanitary, attractive food preparation cutting board made of hardwood or colored non-wood material, having a high-friction non-slip backing applied, which fits on top of recreational vehicle stove burners to silence rattles, add counter space, and enhance interior decor, and which is relatively inexpensive and is easily stored when not in use.

15 Claims, 1 Drawing Sheet

COMBINATION STOVE TOP COVER AND CUTTING BOARD FOR RECREATIONAL VEHICLES

BACKGROUND OF THE INVENTION

1. Field of the Invention

This invention relates to stove top covers for recreational vehicles and to food cutting and slicing boards.

2. Description of Prior Art

Stove top covers for recreational vehicles have become available and are in general use for three basic reasons:

1. To provide additional counter space to augment the very limited work/storage surface available in recreational vehicle kitchens.

2. To quiet the rattle and vibrations caused by the typical stove burners and grates when recreational vehicles are in motion.

3. To enhance the appearance of the kitchen area in recreational vehicles by concealing the stove top cooking surface.

Stove top covers currently designed for recreational vehicles may provide one or more of these functions.

They are generally metal covers that fold up to expose some or all of the concealed burners when cooking is desired. Some such covers attach directly to the stove top, while others surround the stove top and rest on the counter. At least one type of current stove top cover is a rectangular board type which has projections attached to the underside to fit into the centers of the stove burner rings.

Stove top covers which attach directly to the stove top usually provide concealment of the burners and added counter space but fail to suppress the stove rattle. Instead, they often generate additional rattling due to metal-to-metal contact between the cover and the stove burners.

Those stove top covers which fit completely over the stove top and rest on the counter normally do not touch the burner grates and therefore do not generate any rattle of their own, but neither do they quiet the inherent rattle of the stove burner and grate when the vehicle is in motion.

U.S. Pat. No. 5,115,797 to Hurner (1992) shows a stove top cover consisting of a flat rectangular platform having projections attached by screws to the underside designed to fit into the central openings of the stove burner grates, thus holding the cover in place and quieting the burner and grate rattle.

A disadvantage in Hurner's cover is the requirement that the cover must be designed specifically for a particular model of recreational vehicle stove, in order that the projections (feet) will fit properly into the center of each burner grate. Therefore, separate models of the cover, each with a different stock number, are required. As a result, the cover is not readily adaptable to stocking by a distributor.

Hurner's cover also requires considerable space to store out of the way when using the stove for cooking, since the projecting feet do not allow sliding the cover into a narrow space.

Additionally, the feet on Hurner's cover must be sheathed with a rubber-like substance in order to provide the function of suppressing rattle and vibration between the feet and the stove burner grates.

The requirements of having multiple models and sheathing the feet with dampening material result in substantial manufacturing expenses and therefore a relatively high cost to the consumer.

While cutting boards are generally available and in common use, storage space in most recreational vehicles is at such a premium that there is frequently no satisfactory niche in which to carry a substantial, full size cutting board for use in food preparation.

OBJECTS AND ADVANTAGES

Accordingly, besides the objects and advantages of the stove top covers described above, several objects and advantages of the present invention are:

1. To provide a combination stove top cover and cutting board for recreational vehicles that is also an attractive, durable cutting and slicing board which may be used while on the stove top or on a counter, table or other surface.

2. To provide a combination stove top cover and cutting board for recreational vehicles which utilizes a simple non-slip backing to hold it in place on the stove top or on another surface.

3. To provide a combination stove top cover and cutting board with non-slip backing which suppresses the rattle and vibration typical of recreational vehicle stove burners and grates when vehicle is in motion.

4. To provide a combination stove top cover and cutting board for recreational vehicles which is compact, unitized, and having no projecting components, and which therefore is easily stored out of the way when not in use.

5. To provide a combination stove top cover and cutting board for recreational vehicles which is simple and economical to manufacture, and therefore relatively inexpensive to the consumer.

6. To provide a combination stove top cover and cutting board for recreational vehicles which is universal in application so that a single model will fit all the full-size stoves currently in use in motor homes and travel trailers.

Further objects and advantages are to provide a combination stove top cover and cutting board which is also readily adaptable as an attractive and useful serving tray, and which can be easily and economically manufactured in different materials and colors to enhance and complement the decor of the recreational vehicle.

Still further objects and advantages will become apparent from a consideration of the ensuing description and drawings.

DRAWING FIGURES

REFERENCE NUMERALS IN DRAWINGS

Figure 1:
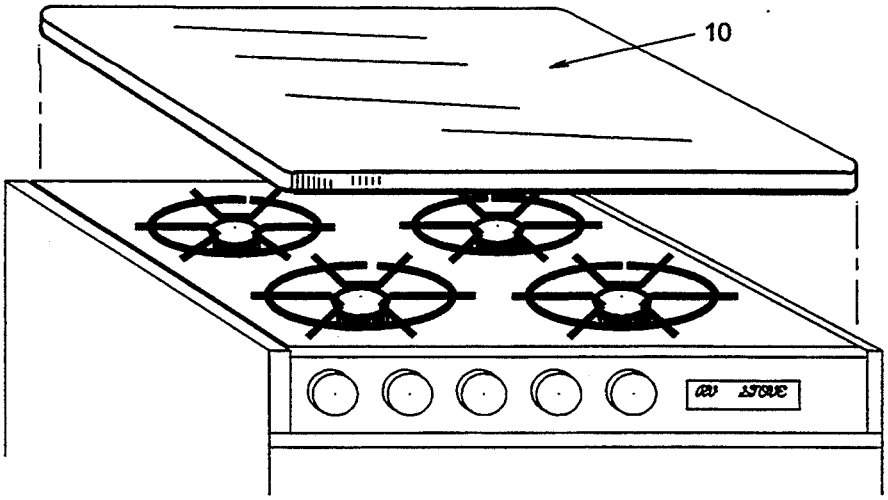
FIG. 1 shows a perspective view of a combination combination stove top cover and cutting board.

10 combination stove top cover and cutting board
20 board
30 non-slip backing
40 groove
50 cleat
60 panel

DESCRIPTION

Figure 2:
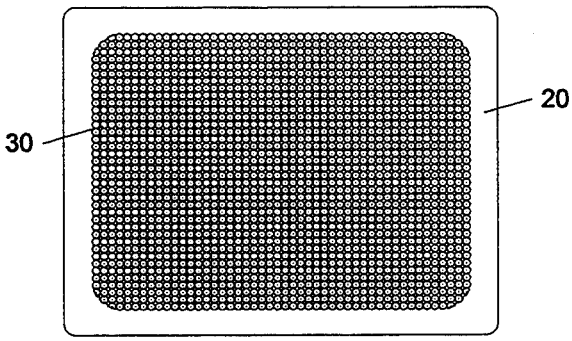
FIG. 2 shows a plan view of the underside of a combination stove top cover and cutting board.
Figure 3:
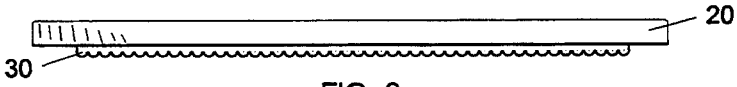
FIG. 3 shows an edge view of a combination stove top cover and cutting board.

A typical embodiment of the combination stove top cover and cutting board is illustrated in FIGS. 1–3.

In this embodiment the combination stove top cover and cutting board 10 consists of a board 20 made of polyethylene, which is readily available in a variety of colors, and a non-slip backing 30 of a high-friction material which is attached with adhesive.

Figure 4:
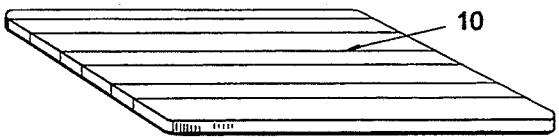
FIG. 4 shows a combination stove top cover and cutting board constructed of laminated hardwood sections.

An alternative embodiment of the combination stove top cover and cutting board (FIG. 4) consists of a laminated hardwood cutting board 10 to which a non-slip backing of a high-friction material is attached with adhesive. The hardwood board is then treated with a wood preservative oil for enhancement of appearance and to protect against drying.

Figure 5:
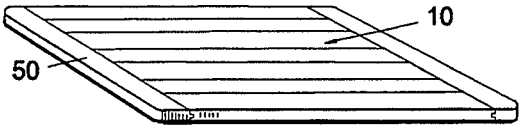
FIG. 5 shows a combination stove top cover and cutting board constructed of hardwood sections with hardwood cleats at each end.
Figure 6:
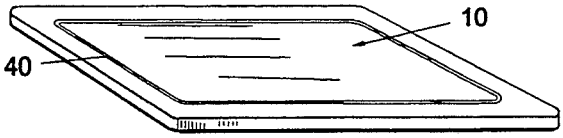
FIG. 6 shows a combination stove top cover and cutting board with a juice groove cut into top surface.
Figure 7:
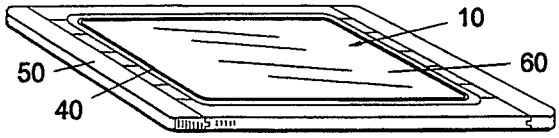
FIG. 7 shows a combination stove top cover and cutting board of hardwood, with cleats, and having a polyethylene cutting panel with juice grooves fitted into a hollow cut in the top surface of the board.

A third embodiment of the combination stove top cover and cutting board (FIG. 6) incorporates a juice groove 40 inside the perimeter of the top surface of the cover/board, the board being made of either hardwood, polyethylene, or other material Other embodiments of the combination stove top cover and cutting board include a laminated hardwood board with hardwood cleats 50 fitted to the ends of the linear hardwood sections(FIG. 5), and a hardwood board (FIG. 7) with end cleats 50 in which a portion of the top surface is hollowed out and a polyethylene (or similar material) cutting panel 60 is fitted into the hollow. This panel, like the polyethylene board, is available in decorator colors and may have a juice groove in its top surface.

In all embodiments, the combination stove top cover and cutting board has dimensions which will fit over all standard three or four burner stoves currently in use in recreational vehicles.

OPERATION

The manner of using the combination stove top cover and cutting board is to place the cover/board on top of the stove cooking surface after it has cooled from cooking. The non-slip backing holds the cover/board securely in place.

When cooking is desired, the cover/board is removed from the stove top and can be easily stored due to its slim, compact design.

Alternatively, the cover/board may be used as a cutting board for food preparation by placing it on the counter or a table or other support, its non-slip backing holding it firmly in place.

Since food prepared in recreational vehicle kitchens is frequently served outside the vehicle, the combination stove top cover and cutting board functions as an attractive serving tray.

SUMMARY, RAMIFICATIONS AND SCOPE

Accordingly, the reader will see that the combination stove top cover and cutting board for recreational vehicles of the present invention provides recreational vehicle owners with a practical, relatively inexpensive solution to the:

Annoyance of stove top rattle,

Frustration of very limited counter space,

Recurring requirement for a food preparation cutting board, and

Enhancement of the interior decor and color scheme of the recreational vehicle.

Furthermore, the combination stove top cover and cutting board of the present invention:

Is compact for easy storage when not in use.

Functions as an attractive serving tray in addition to its dual primary uses.

Fits all full-size cooking stoves used in recreational vehicles.

Requires only one model and size to facilitate ordering and stocking by distributors.

Although the description above lists several emodiments of the combination stove top cover and cutting board, these should not be construed as limiting the scope of the invention but as merely providing illustrations of some of the presently preferred embodiments of this invention.

Thus the scope of the invention should be determined by the appended claims and their legal equivalents, rather than by the examples given.

Therefore I claim:

1. A stove top cover in combination with a stove designed to conceal and silence the stove top burners in recreational vehicles, the combination comprising:

(a) a stove top cover, said stove top cover comprising a generally rectangular platform having planar top and bottom surfaces (b) a high-friction backing affixed to substantially all of said bottom surface of said platform such that said high-friction material is sandwiched between said platform and said stove top burners when said platform is in place on top of said stove so that said high-friction backing extends uninterrupted and in a contiguous manner among said stove top burners.

2. The combination as defined in claim 1 wherein said platform is composed of a polymeric material.

3. The combination as defined in claim 1 wherein said platform s composed of a hardwood.

4. The combination as defined in claim 1 wherein said platform is composed of laminated hardwood sections.

5. The combination as defined in claim 1 wherein said top surface of said platform defines a depression, a panel, said panel fitted into said depression.

6. The combination as defined in claim 4 and including hardwood cleats, said hardwood cleats attached to said hardwood sections.

7. The combination as defines in claim 1 wherein said top surface of said platform defines a groove.

8. The combination of claim 1 comprising a stove having a plurality of burners, said stove top cover positioned atop said stove burners.

9. A combination stove top cover and for use in a recreational vehicle, comprising:

(a) a generally rectangular platform composed of a hardwood, said platform having planar top and bottom surfaces of predetermined dimensions and having edges of a predetermined depth, (b) a high-friction backing composed of a non-slip material permanently attached to substantially all of said bottom surface of said platform such that said high friction material is sandwiched between said platform and said stove top burners when said platform is in place on top of said stove, said high-friction backing extending uninterrupted and in a contiguous manner among said stove top burners whereby users of recreational vehicles can silence rattling stove burners, utilize added counter space and a sanitary food preparation surface, and enhance the interior appearance of the recreational vehicle.

10. The combination as defined in claim 9 wherein said platform is composed of a polymeric material.

11. The combination as defined in claim 9 wherein said platform is composed of hardwood strips laminated side by side, said strips having coterminus ends.

12. The combination as defined in claim 11 wherein said hardwood strips are bound by hardwood cleats, said cleats attached to said ends of said strips.

13. The combination as defined in claim 9 wherein top surface of said platform defines a depression of predetermined depth and dimensions, a panel, said panel positioned in said depression.

14. The combination as defined in claim 9 wherein a surface of said platform defines a groove.

15. A stove top cover comprising: a generally rectangular platform having planar top and bottom surfaces, said top surface defining a depression, a panel, said panel fitted into said depression and a high-friction backing, said high friction backing affixed to substantially all of said bottom surface of said platform.

* * * * *